United States Patent [19]

McCullough

[11] Patent Number: 4,984,955

[45] Date of Patent: Jan. 15, 1991

[54] LIFT APPARATUS

[76] Inventor: Robert C. McCullough, 185 Baltic Street, Coquitlan, British Columbia, Canada, V3K 5G9

[21] Appl. No.: 316,337

[22] Filed: Feb. 23, 1989

[51] Int. Cl.[5] ..... B66B 9/20

[52] U.S. Cl. ..... 414/546; 414/921; 187/9 R

[58] Field of Search ..... 414/546, 556, 557, 921, 414/917; 187/9 R, 62; 49/33, 131, 133, 366

[56] References Cited

U.S. PATENT DOCUMENTS

| | | | |
|---|---|---|---|
| Re. 30,462 | 12/1980 | Pohl . | |
| Re. 31,178 | 3/1983 | Deacon . | |
| 2,350,641 | 6/1944 | Ruddock | 414/557 |
| 3,305,112 | 2/1967 | Brown | 414/557 |
| 3,826,386 | 7/1974 | Tauer . | |
| 3,913,759 | 10/1975 | Deacon . | |
| 4,010,859 | 3/1977 | Ronian | 414/546 |
| 4,124,130 | 11/1978 | Rohrs et al. . | |
| 4,155,468 | 5/1979 | Royce | 414/55 C |
| 4,252,491 | 2/1981 | Hock . | |
| 4,265,586 | 6/1981 | Couture . | |
| 4,285,416 | 8/1981 | Dudynskyj . | |
| 4,347,030 | 8/1982 | Kingston . | |
| 4,534,450 | 8/1985 | Savaria | 414/921 |
| 4,674,601 | 6/1987 | Benjamin | 414/546 |
| 4,813,842 | 3/1989 | Mortar | 414/557 |

*Primary Examiner*—Galen Barefoot

*Attorney, Agent, or Firm*—Hughes & Multer

[57] ABSTRACT

The present invention comprises a lifting apparatus installed near or upon a generally horizontal raised bed of a vehicle for safely moving a wheelchair and its occupant operator to and from the raised bed. The lift apparatus uses a single actuating means to automatically and sequentially serve three distinct functions: (1) appropriately engages one or more safety barriers before a laterally extending support platform is moved, thereby preventing the wheelchair and operator from falling off of the platform; (2) moves the platform between a lower support position located at ground level and an upper support position located at floor level; and (3) moves the platform between a generally horizontal, laterally extending support position and a compact, generally upright stowed position. The lift apparatus is also designed to prevent an appendage of the operator from becoming pinched when the support platform is raised from the support position to the stowed position.

18 Claims, 9 Drawing Sheets

LIFT APPARATUS

TECHNICAL FIELD

This invention relates to lift devices and, more particularly, to a compact, electrically operated lift apparatus used to assist an occupant of a wheelchair to enter and exit a vehicle. The present invention is designed to prevent an appendage of the operator from becoming pinched or injured during movement of a support platform. The present invention also has a single actuating means to sequentially control the movement of one or more safety barriers, the platform, and a mounting portion. The safety barriers prevent the wheelchair from leaving the support platform except when the platform either rests upon the ground or is positioned level with a raised bed of the vehicle.

BACKGROUND ART

Persons confined to a wheelchair are often faced with a difficult task of having to move themselves to and from a raised bed of a vehicle. Numerous lifting devices have been developed to assist handicapped individuals to transport themselves to and from a vehicle without requiring the assistance of another person. The following patents relate to such lifting devices known in the prior art: Tauer (U.S. Pat. No. 3,826,386; issued July 30, 1974); Deacon (U.S. Pat. No. 3,913,759; issued Oct. 21, 1975); Deacon (U.S. Pat. No. Re. 31,178; issued Mar. 15, 1983); Hock (U.S. Pat. No. 4,252,491; issued Feb. 24, 1981); Couture (U.S. Pat. No. 4,265,586; issued May 5, 1981); Dudynskyj (U.S. Pat. No. 4,285,416; issued Aug. 25, 1981); Kingston (U.S. Pat. No. 4,347,030; issued Aug. 31, 1982); and Pohl (U.S. Pat. No. Re. 30,462; issued Dec. 30, 1980). Most of these references disclose lifts which are mounted near a door opening of a van-type vehicle. The lift platforms are often hinged to enable the platforms to be folded into an upright position within the vehicle when not in use.

Rohrs et al. (U.S. Pat. No. 4,124,130; issued Nov. 7, 1978) discloses a safety barrier for a wheelchair lift.

Safety, stability, and ease of operation are of primary concern in the design of a lifting device. The devices known in the prior art have been only partially successful in meeting these objectives and have been relatively bulky, complex in construction, expensive to fabricate and install, and have been subject to breakdown and tampering. Safety barriers to prevent the wheelchair and its occupant from falling off of the lift, either off of the outer edge of the lift and/or down through the gap between the inner edge of the lift and the vehicle, have either not been provided or have been less effective than those found in the present invention. Exposed chains and linkages of the prior art present not only a source of annoyance, wherein the operator or occupants of the vehicle may contact such elements and become soiled, but also present a major safety hazard if contacted during the operation of the lift. Many of the previously known lift devices also have a tendency to sway, rotate, jump, or bind as the lift is being operated.

The Applicant and his attorneys believe the listed patents taken alone or in combination neither anticipate nor render obvious the present invention. The citations do not constitute an admission that such references are relevant or material to the present claims. The above cited references only relate to the general field of the disclosure, and are cited as constituting the closest art of which the Applicant and his attorneys are aware. None of such references incorporate the combination of features taught in the present invention. Nor do such previously known devices incorporate the same degree of safety as found in the present invention.

DISCLOSURE OF INVENTION

It is a general objective of the present invention to provide an improved, safe, stable, and relatively maintenance-free lift apparatus which can be easily operated by a severely handicapped individual who is confined to a wheelchair and has low dexterity, the lift apparatus being used to safely move the wheelchair and operator to and from a raised bed of a vehicle.

Another general objective is to provide an apparatus designed to prevent an appendage of the operator from becoming pinched during the movement of a support platform.

An additional general objective is to provide an apparatus having a single actuating means which automatically and sequentially controls three distinct functions: (1) appropriately engages one or more safety barriers before the laterally extending support platform is moved, thereby preventing the wheelchair or operator being transported upon the platform from falling off of the platform; (2) moves the platform between a lower support position located at ground level and an upper support position located at floor level; and (3) when the wheelchair and its occupant have exited the platform, moves the platform between a laterally extending support position and a generally upright stowed position.

Further objectives are to provide a lift apparatus which is relatively simple in construction, is easy to install, requires relatively few attachment locations to the vehicle, and is capable of compact storage within the vehicle when not in use.

The present invention is an improved, extremely safe, stable, and relatively maintenance free lift apparatus which may be used to transport a wheelchair and its operator between a lower support position located near ground level and an upper support position located generally even with a raised bed of a vehicle. The lift apparatus is relatively simple in construction, is easily installed, and may be compactly stored within the vehicle. A single actuating means is used to control the movement of each element of the lift apparatus, enabling even a severely handicapped individual having low dexterity to operate the lift. To achieve the aforesaid objectives, the lift apparatus has a linkage means, a support platform, and an actuating means.

The linkage means is secured to the vehicle and to the support platform in such a manner as to give the platform structural integrity and stability during movement. For example, the linkage means may comprise the combination of a base portion, a linkage portion, and a mounting portion. The base portion is secured to the vehicle so as to have a fixed vertical orientation relative to the raised bed. The linkage portion interconnects the base portion and the mounting portion so that the mounting portion maintains a fixed vertical orientation relative to the base portion and is movable relative to the base portion between a laterally extending support position and a generally upright, closed, stowed position. The linkage portion may comprise two or more intermediate parallel linkages or elongated parallelogram suspension arms of substantially equal length which are pivotally fastened to the base and mounting portions. Movement of the linkage portion causes the mounting portion to move between a lowered, extended position and a raised, closed position.

In its raised, closed position, the mounting portion is juxtaposed against the base portion. This enables the operator of the lift to grasp either the mounting or base portions of the lift to assist him or her in entering or exiting the vehicle, without exposing the operator to a danger of having an appendage or piece of clothing become caught between the mounting and base portions. Such protection is maintained during loading and unloading of the support platform and during the raising and lowering of the platform between its laterally extending support position and its stowed position.

The support platform is operatively attached to the mounting portion to enable the entrance and exit of a wheelchair and its occupant. During operation, the support platform serves as a operator generally horizontal laterally extending support bed or platform upon which the wheelchair and operator ride. Movement of the mounting portion causes the support platform to be raised or lowered. The platform assumes a lower support position level with the ground and rests upon the ground when the mounting portion is in its extended position. The platform assumes an upper support position level with the raised bed of the vehicle when the mounting portion is in its closed position The platform maintains its vertical orientation with respect to the mounting and base portions as it is being raised between its lower and upper support positions.

The support platform is preferably pivotally secured to the mounting portion. This permits the support platform to be pivoted to a stowed position within the vehicle when not in use. The support platform may use a safety cable secured between the platform and mounting portion to support the platform in its laterally extending position and control the pivotal action of the platform. The safety cable may have an adjustable length to adjust the angle of the platform with respect to the mounting portion.

The platform also preferably has one or more devices which can serve as safety barriers. For example, the safety cables may serve as a barrier to prevent the wheelchair and operator from falling sideways off of the platform. The operator may also safely hold or grasp the safety cables while being raised or lowered upon the platform without fear of becoming injured or soiled. Elongated guide rails may be provided along the sides of the platform to prevent the wheelchair from accidentally rolling off of the sides of the platform. A gate means and a bridge means may also be provided to prevent the wheelchair and operator from falling off of either the outer or inner edges of the platform. The gate means and bridge means may be pivotally attached to the platform, the gate means being attached to the outer edge of the platform, and the bridge means being attached to the inner edge of the platform. In the preferred embodiment, activation of the actuating means automatically and sequentially engages and disengages such safety features.

The lift apparatus is operated by a single actuating means which serves to control the movement of: the gate means, the bridge means, the support platform, and the mounting portion. More specifically, the actuating means automatically and sequentially controls three distinct functions (1) appropriately engages the gate means and/or bridge means into safety barrier positions before the platform is raised or lowered; (2) moves the platform between the lower and upper support positions by raising or lowering the mounting portion between an extended and closed position; and (3) moves the platform between the laterally extending support position and the generally vertical stowed position after the wheelchair and operator have exited the platform.

The actuating means may comprise a variety of drive systems. For example, the actuating means in the preferred embodiment comprises a cable means, a winch means, and a control means. The cable means is operatively attached to the winch means which in turn is operated by the control means. The cable means comprises one or more cables stretched between rotatable sheaves located and secured at strategic locations within the framework of the lift apparatus. The sheaves are located so as to position the cables within channels of the base and mounting portions of the lift, removing the cables from the areas of the lift used by the operator.

The winch means may comprise any means whereby the cable means are extended and retracted. For example, the winch means may be a powered, reversible drive motor having one or more take-up drums operatively attached thereto.

The control means may be a single remote or radio controlled switch, or the like.

During operation, the control means may be engaged to activate the winch means and thereby extend or retract the cable means. When the cable means is sufficiently extended, the support platform rests upon the ground to assume its lower support position. The gate means is urged by an urging means, such as a compression spring, to pivot downward toward a ramp position. When in the ramp position, the gate means allows easy entry and exit to the support platform at ground level. When the platform is in its lower support position, the bridge means is pivoted upward to a raised safety barrier position, preventing the wheelchair from falling between the platform and the vehicle.

When the cable means is retracted, the gate means is first raised to a safety barrier position to prevent the exit of the wheelchair from the outer edge of the platform. The gate means is raised before the platform is lifted off of the ground. As the cable means is further retracted, the mounting means is moved from an extended position toward a closed position. The gate means remains in its raised safety barrier position. The bridge means slowly pivots downward as the platform is raised until the mounting portion reaches its closed position. When the mounting portion is in its closed position, the bridge means serves as a bridge or ramp from the support platform to the raised bed of the vehicle, enabling easy entry and exit of the wheelchair into the vehicle.

If the load has been removed from the support platform and the cable means is further retracted, the platform is pivoted from a laterally extending support position to a generally upright stowed position located adjacent to the mounting portion.

Where the platform is initially in its stowed position and the cable means is extended, a compression spring urges the platform away from the mounting portion. Once the cable means is released, gravity acts upon the platform forcing the platform to pivot about a pivot pin and move from the upright stowed position to a laterally extending support position. The safety cables support the platform against excessive pivotal movement.

If the cable means is further extended, gravity acts upon the platform and the mounting portion to urge the platform downward from a raised support position to a lower support position. During this step, the linkage portion allows for rotational movement, permitting the mounting portion to be moved from a closed position to an extended position. The platform is consequentially suspended outwardly and downwardly from the raised bed until the platform rests upon the ground, reaching its lower support position.

One should understand the drawings are not necessarily to scale and the elements are sometimes illustrated by graphic symbols, phantom lines, diagrammatic representations, and fragmentary views. In certain instances, the Applicant may have omitted details which are not necessary for an understanding of the present invention or which render other details difficult to perceive.

BEST MODE FOR CARRYING OUT THE INVENTION

Figure 1:
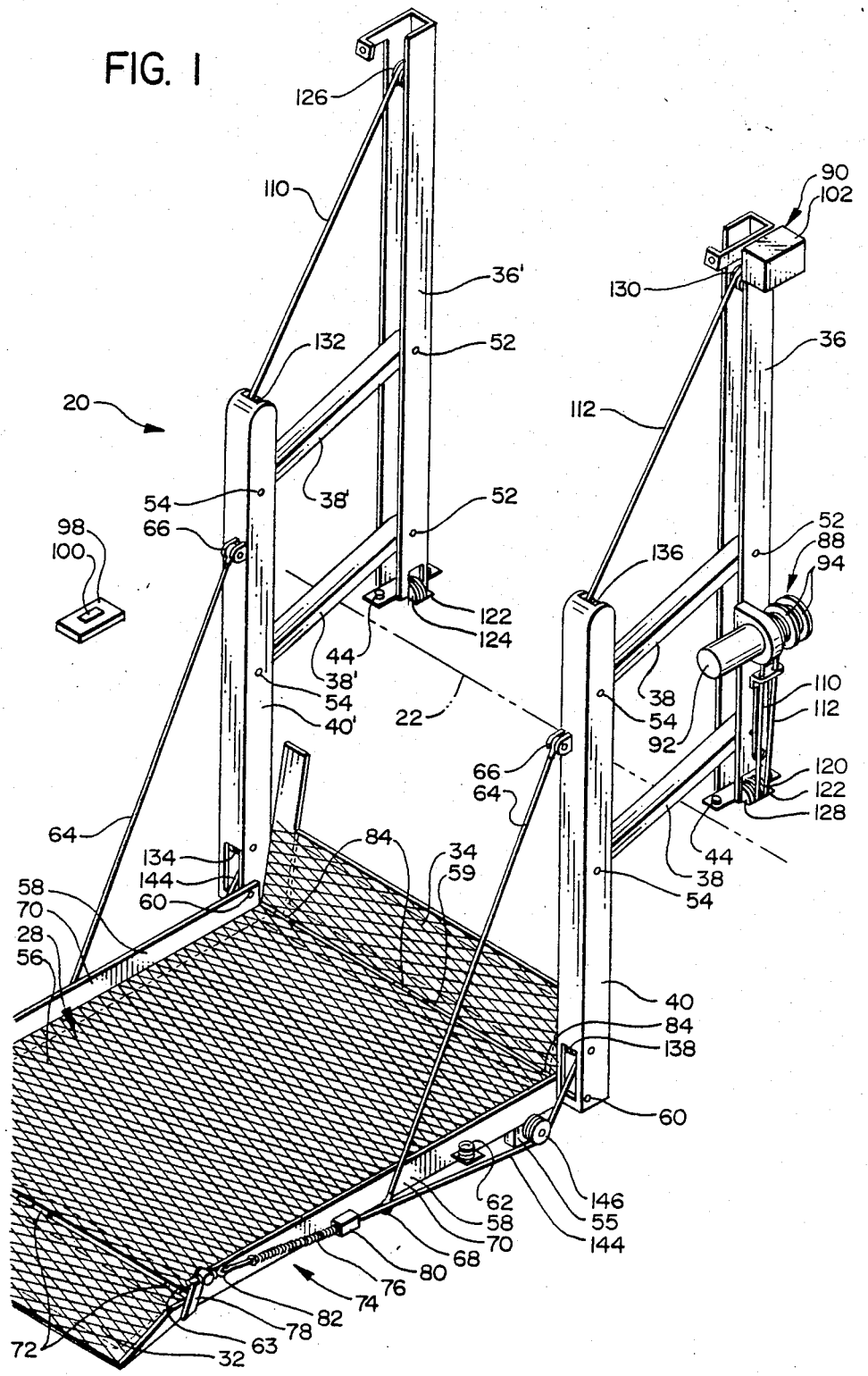
FIG. 1 is a perspective view of a lift apparatus made in accordance with this invention.

Referring to the drawings and particularly to FIG. 1, wherein like numerals indicate like parts, an improved, safe, stable, and relatively maintenance-free lift apparatus 20 is provided to safely move a wheelchair and its occupant to and from a raised bed 22 of a vehicle 24 (shown in FIGS. 2 through 7). Lift apparatus 20 can be easily operated from the wheelchair, even by a severely handicapped individual having low dexterity. Lift apparatus 20 is relatively simple in construction, is easily installed, and is capable of being stored compactly within vehicle 24 when not in use.

In general, lift apparatus 20 comprises: a linkage means 26; a support platform 28; and an actuating means 30.

Linkage means 26 is secured to vehicle 24 and to platform 28. Generally, the purpose of linkage means 26 is to give structural integrity and stability to platform 28 as platform 28 is raised and lowered between a lower support position located at ground level and an upper support position located at floor level.

Support platform 28 is preferably pivotally connected to linkage means 26, thus enabling platform 28 to be folded into a generally upright stowed position within vehicle 24 when not in use. Prior to being used, platform 28 is pivoted downward to form a laterally extending support surface which is capable of supporting the wheelchair and its occupant for movement between the upper and lower support positions.

Actuating means 30 automatically and sequentially controls three distinct functions: (1) appropriately moves a movable gate means 32 and/or a movable bridge means 34 into a position to serve as a safety barrier before platform 28 is raised or lowered, thus preventing the wheelchair and its occupant from inadvertently falling off of platform 28; (2) moves platform 28 between the lower and upper support positions; and (3) when the wheelchair and its occupant have exited platform 28, moves platform 28 between the laterally extending support position and the stowed position.

Each of these general elements will now be discussed in greater detail. For clarity, reference numerals 26 and 30 are not shown in the drawings. Instead, the individual elements which comprise linkage means 26 and actuating means 30 are indicated.

LINKAGE MEANS

Figure 3:
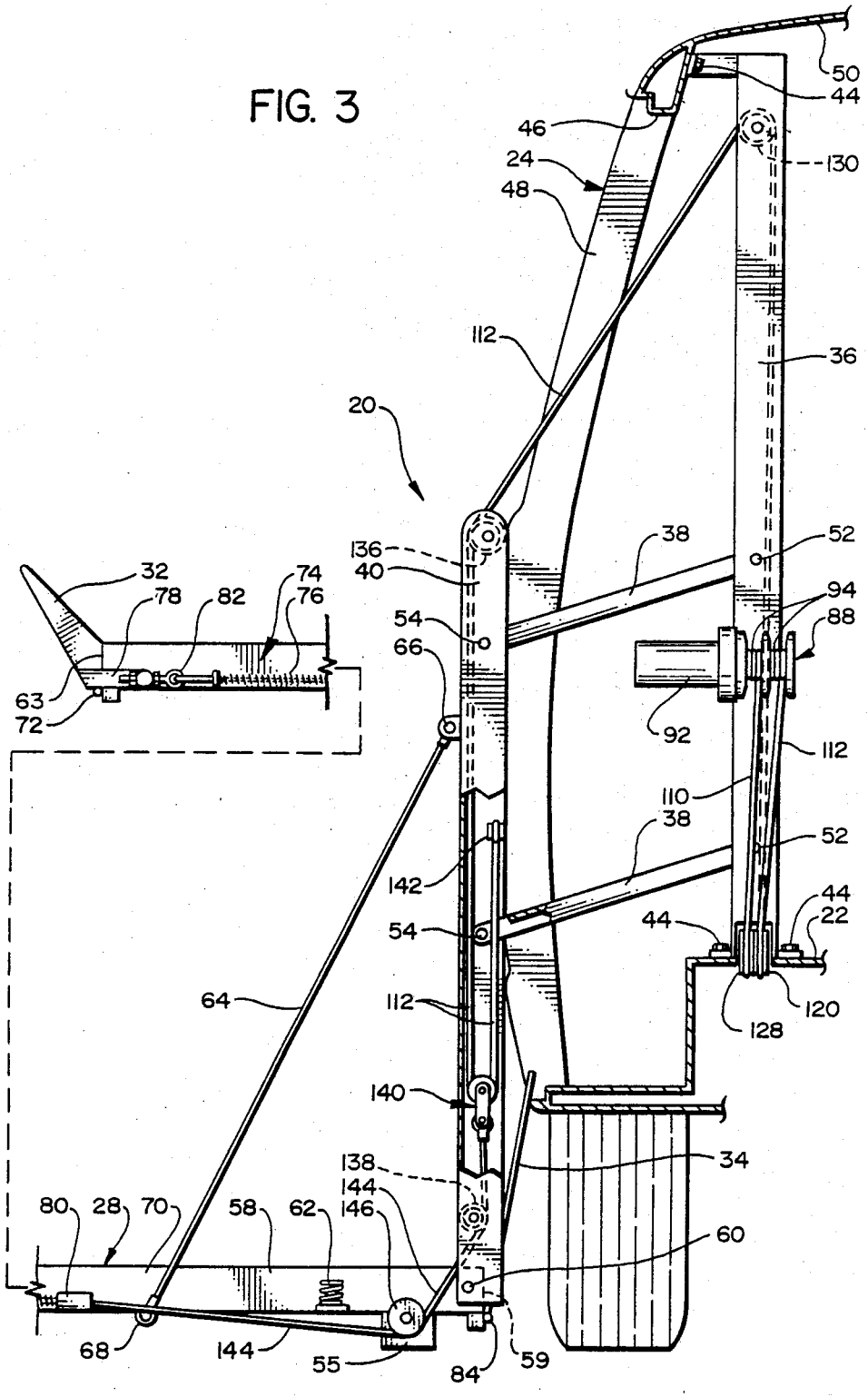
FIG. 3 is a partial side elevational view of the lift apparatus shown in FIG. 2 with the gate means being pivoted to serve as a safety barrier to prevent a load from falling off of the outer edge of the platform.
Figure 4:
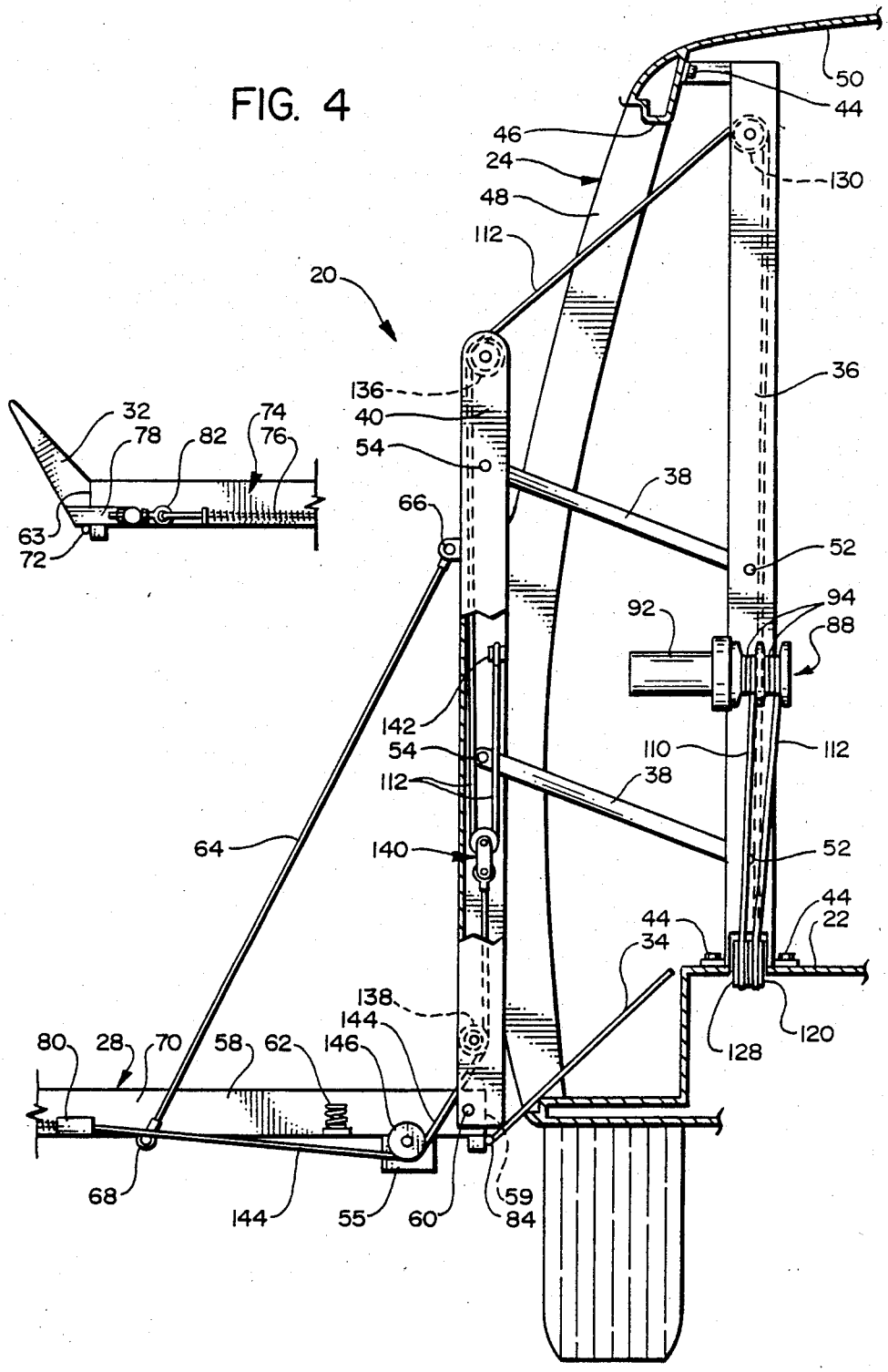
FIG. 4 is a partial side elevational view of the lift apparatus shown in FIG. 3 with the platform and mounting portion being partially raised to an intermediate position, the gate means and bridge means serving as safety barriers.

As shown most clearly in FIGS. 1, 3 and 4, linkage means 26 comprises a base portion 36, a linkage portion 38, and a mounting portion 40 which are connected in such a way as to form an extendable and retractable parallelogram.

Base portion 36 has a fixed vertical orientation relative to raised bed 22. A relatively fixed vertical orientation is required to maintain angular uniformity during the movement of platform 28 between the upper and lower support positions. Such vertical orientation may be achieved by securing base portion 36 to the structural framework of vehicle 24.

Lift apparatus 20 of the present invention has been specifically designed so that base portion 36 may be bolted or otherwise secured to the existing frame structure of a wide variety of vehicles, without requiring modification of the vehicle itself. Only a few points of attachment are required. The particular purpose for which lift apparatus 20 is built, the appropriate clearance requirements, and the structural support features which are available, affect the location and method by which base portion 36 is attached.

In the preferred embodiment, base portion 36 is secured to the interior structural framework of a van-type vehicle just inside and adjacent to an access opening 42 (shown in FIG. 7) of vehicle 24 by means of several bolts or fasteners 44. Access opening 42 must be sufficiently large to allow for installation and for movement of the wheelchair and its occupant. The points of attachment are to the floor or raised bed 22 and to an overhead threshold 46 of a door jamb or frame 48 with approximately 10 mm (3/8 inch) bolts or fasteners 44 (shown in FIGS. 1 and 6). Only eight fasteners 44 are needed. Other means of fastening lift apparatus 20 to vehicle 24 may also be used.

For permanent installation, base portion 36 may be welded into place. Other alternative methods of attachment include: securing base portion 36 to door frame 48 and/or to a ceiling 50 of vehicle 24; mounting base portion 36 to a pivotal platform (not shown) which in turn is secured to raised bed 22; or securing base portion 36 outward of vehicle 24 to the exterior structural framework of vehicle 24. Exterior placement, however, may expose lift apparatus 20 to weather damage and vandalism.

Linkage portion 38 interconnects base portion 36 and mounting portion 40 in such a manner that mounting portion 40 is movable relative to base portion 36 between an extended position and a closed position. When in its extended position, mounting portion 40 extends outward and downward from vehicle 24 through access opening 42. During such movement, mounting portion 40 maintains its vertical orientation relative to base portion 36. Such movement may be achieved by using a linkage portion 38 comprising two or more intermediate parallel linkages or elongated parallelogram suspension arms of substantially equal length which are pivotally fastened to base portion 36 and to mounting portion 40. For example, linkage portion 38 may pivot on base portion 40 by means of parallel pivot pins 52 which are spaced apart longitudinally along base portion 36. Similarly, linkage portion 38 may pivot on mounting portion 40 by means of parallel pivot pins 54 which are spaced apart longitudinally along mounting portion 40.

Base portion 36 and mounting portion 40 preferably have a channel-shaped cross-section. This enables one end of each linkage portion 38 to be fit into the channels of base portion 36 and mounting portion 40, thereby allowing mounting portion 40 to be juxtaposed against base portion 36 when it is in its closed position.

It is important to note that in the present invention, mounting portion 40 is juxtaposed against base portion 36 when in its closed position, and that platform 28 does not reach its upper support position until mounting portion 40 assumes its closed position. Also note that mounting portion 40 is positioned away from the central area of platform 28. In this way, the operator of lift apparatus 20 is unlikely to grip mounting portion 40 during the movement of platform 28. Unlike the prior art, once platform 28 has been raised to its upper support position, further movement of mounting portion 40 is not required to move platform 28 to its stowed position. This eliminates any possible injury to the operator that might otherwise occur by having clothing or an appendage pinched between mounting portion 40 and base portion 36 as platform 28 is being raised to its stowed position. This is a significant safety improvement over the teachings of the prior art of record.

For high torsional stability, linkage portion 38 is preferably made from materials having a channel-shaped cross-section or is made from square or rectangular structural tubing.

Pivot pins 52 extend through one end of each parallel linkage in linkage portion 38 and pass into aligned holes located in the opposite flanges of base portion 36. Likewise, pivot pins 54 extend through the other end of each parallel linkage and pass into aligned holes located in the opposite flanges of mounting portion 40.

SUPPORT PLATFORM

A laterally extending support platform 28 is attached to a lower end of each mounting portion 40, such that movement of mounting portion 40 between its extended position and its closed position causes platform 28 to move between a lower laterally extending support position and an upper laterally extending support position, respectively.

In its lower support position, platform 28 rests upon the ground outward of vehicle 24 and, consequently, is substantially level with the ground. Blocks 55 may be secured to the underside of platform 28 to support platform 28 when it is resting upon the ground.

Figure 2:
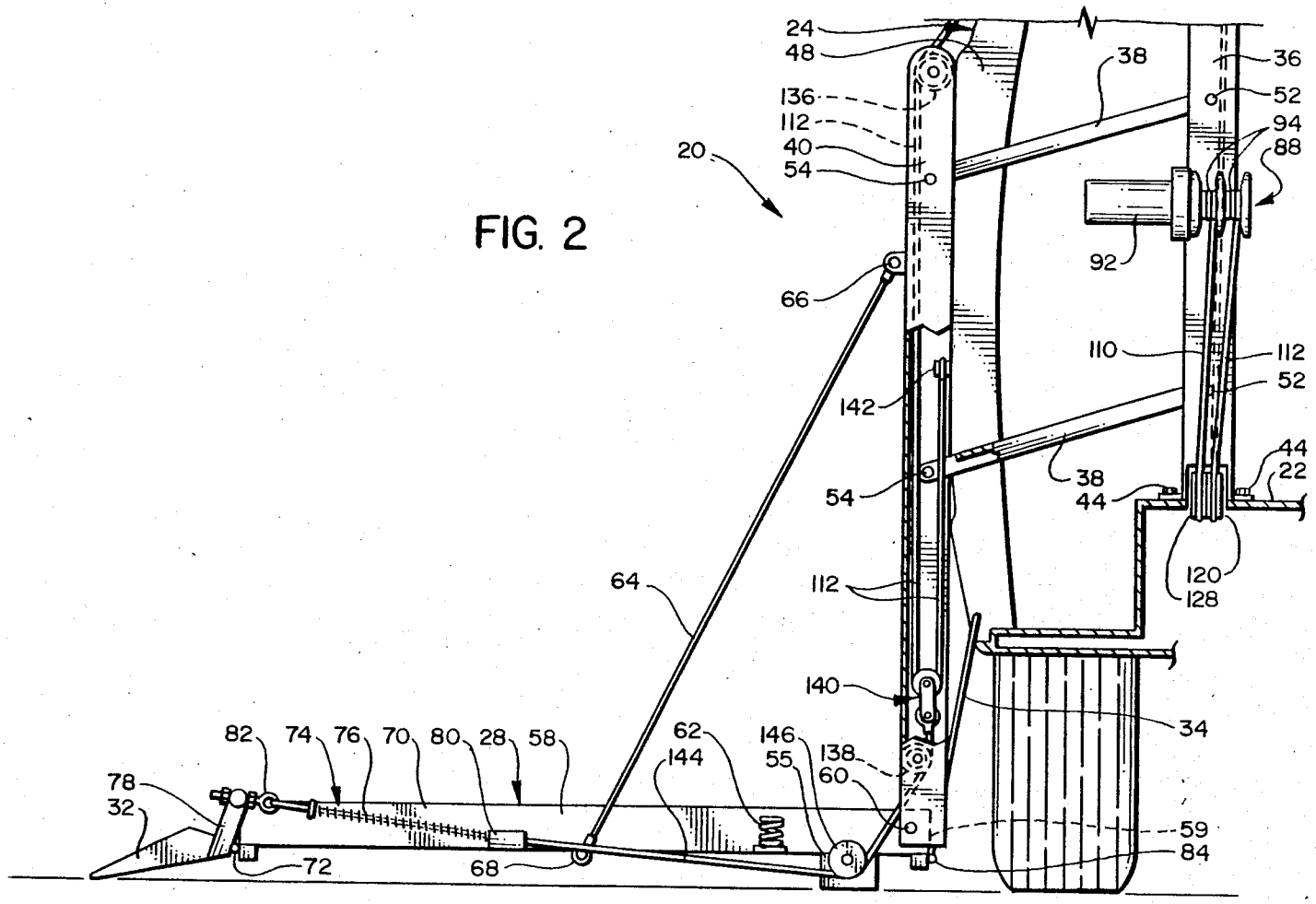
FIG. 2 is a partial side elevational view of the lift apparatus shown in FIG. 1 with a vehicle shown in partial cross-section, a mounting portion being extended to place a support platform in a lower support position, a movable gate means on an outer edge of the platform being urged toward a ramp position, and a movable bridge means on an inner edge of the platform serving as a safety barrier to prevent a load from falling between the platform and the vehicle.

FIGS. 1 to 3 illustrate mounting portion 40 in an extended position and platform 28 in a lower support position. FIG. 4 illustrates mounting portion 40 and platform 28 in an intermediate position, with mounting portion 40 being only partially extended and platform 28 being only partially raised.

Figure 5:
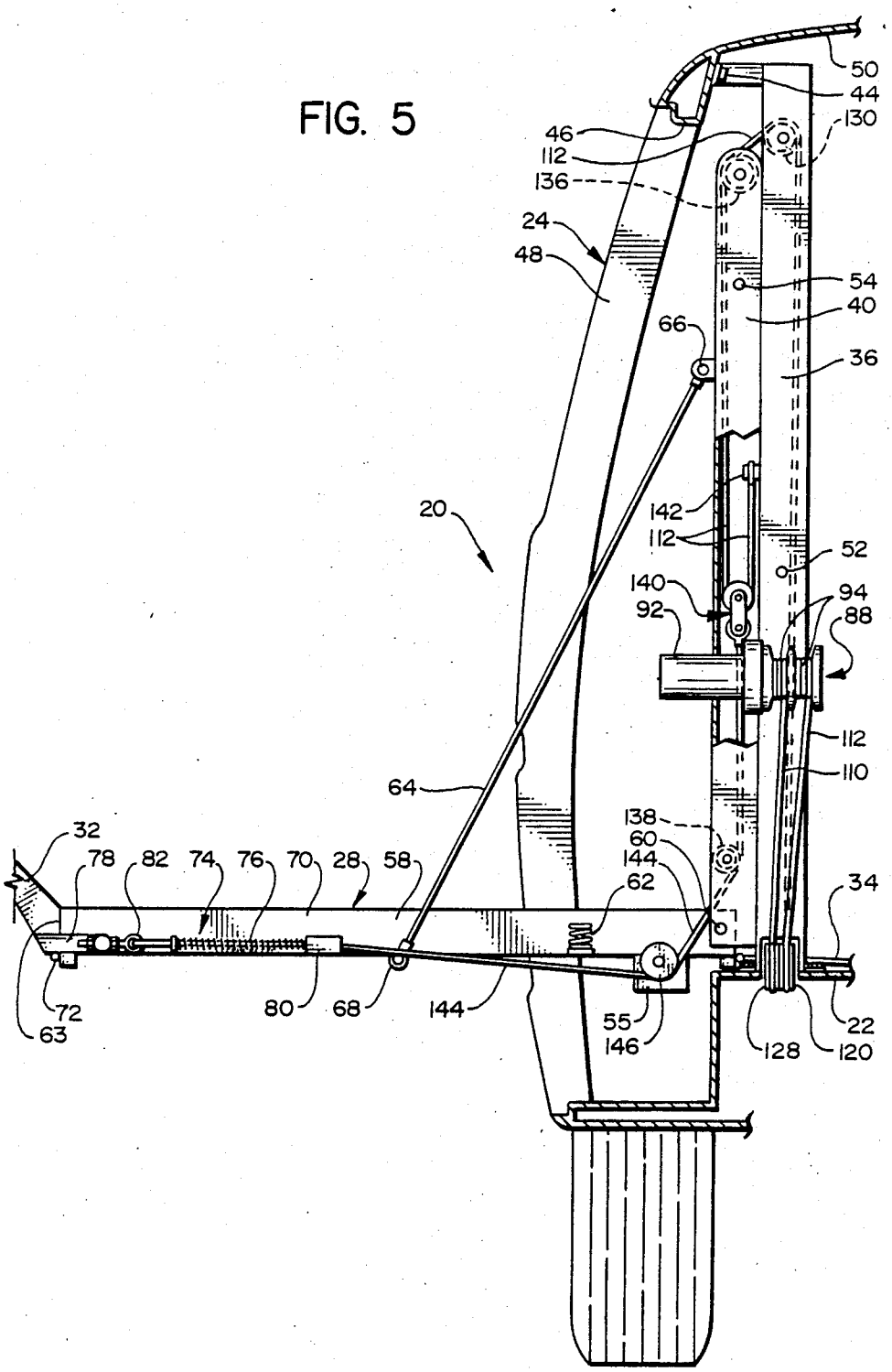
FIG. 5 is a side elevational view of the lift apparatus shown in FIG. 4 with the mounting portion being juxtaposed against a base portion, the platform being raised to an upper support position located at floor level, the platform being generally horizontal and level with the raised bed of the vehicle, the gate means serving as a safety barrier, and the bridge means being pivoted to serve as a bridge across the gap between the platform the raised bed of the vehicle.

When mounting portion 40 is in its closed position, mounting portion 40 is retracted into the interior of vehicle 24, is juxtaposed against base portion 36, and places platform 28 in the upper support position, level with the floor or raised bed 22. FIG. 5 illustrates mounting portion 40 in a closed position against base portion 36, and illustrates platform 28 in the upper support position substantially level with raised bed 22.

Platform 28 is designed with a sufficient width and length to support the load it is intended to carry. In the preferred embodiment, platform 28 is made of an expanded metal gridwork 56 (shown in FIG. 1) placed upon a metal support frame 58. Gridwork 56 helps prevent the wheels of the wheelchair from skidding on soil or water which might accumulate on platform 28. Gridwork 56 also allows such soil or water to escape from platform 28 before platform 28 is raised to its stowed position within vehicle 24.

Figure 6:
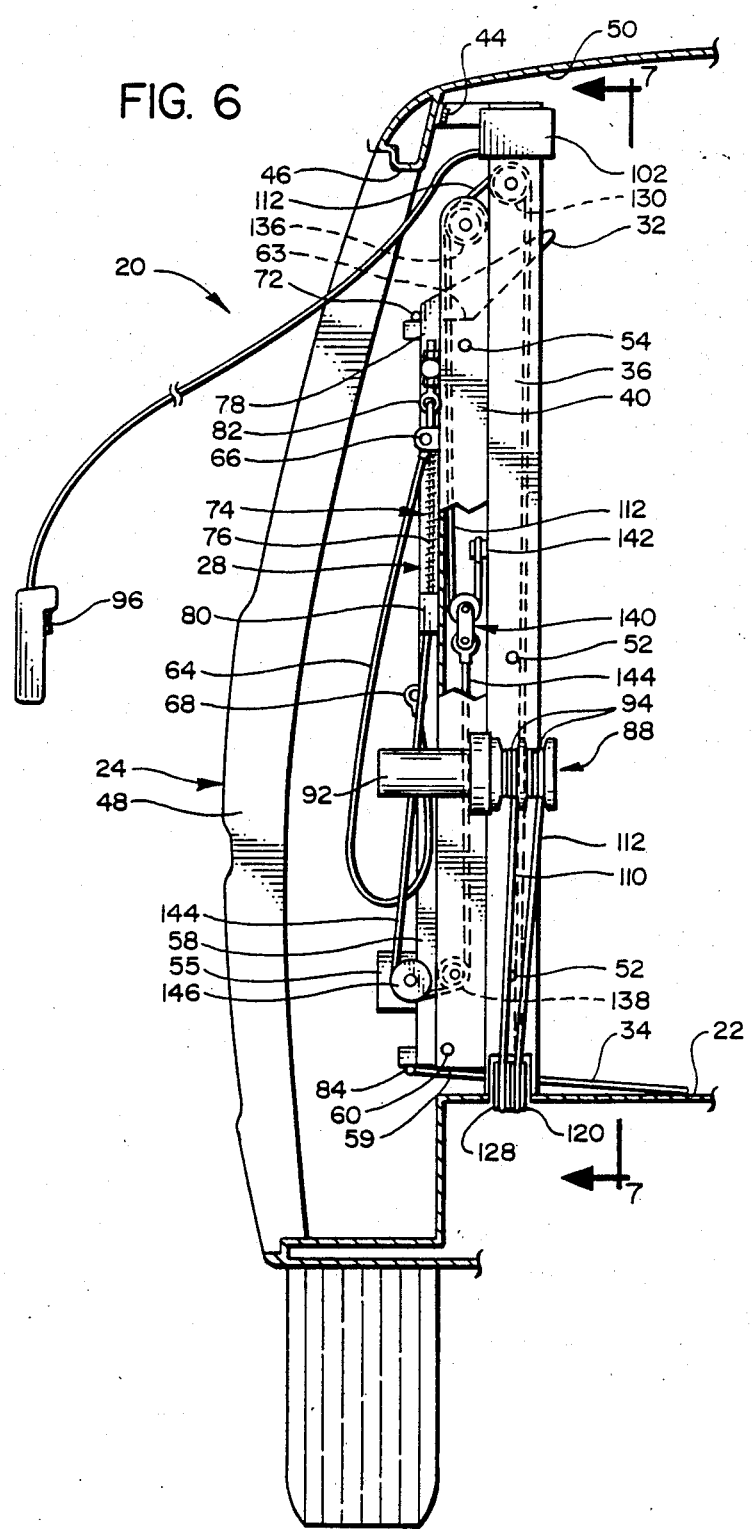
FIG. 6 is a side elevational view of the lift apparatus shown in FIG. 5 with the platform being pivoted to a stowed position.

Platform 28 may be hinged or pivotally attached to mounting portion 40 to enable platform 28 to be folded into a generally upright stowed position within vehicle 24 when not in use. For example, in the preferred embodiment, platform 28 is pivotally attached near an inner edge 59 to the lower ends of mounting portion 40 by means of a pair of aligned pivot pins 60. Each pivot pin 60 projects through a portion of platform 28 and passes into one of the aligned holes located in the opposite flanges of mounting portion 40. Pivot pins 60 define a horizontal axis of rotation for platform 28. Thus, platform 28 may pivot about the horizontal axis of rotation between a laterally extending support position and a stowed position which is generally upright, or at least substantially parallel to a longitudinal axis of mounting portion 40. In its stowed or folded position, platform 28 is substantially contiguous to mounting portion 40. Lift apparatus 20 may alternatively be designed with a small space located between the stowed platform 28 and closed mounting portion 40 to prevent any appendage or clothing from becoming pinched therebetween. FIG. 6 illustrates platform 28 in a stowed position.

To facilitate the urging of platform 28 away from its stowed position, a compression spring 62 (shown in FIG. 1) is provided. Compression spring 62 may be attached to platform 28 in such a manner that when platform 28 is located in its stowed position, compression spring 62 is compressed between platform 28 and mounting portion 40. When platform 28 is released from its stowed position, compression spring 62 urges an outer edge 63 of platform 28 away from mounting portion 40. Gravity then acts to urge platform 28 to pivot about pivot pins 60 and fall outwardly from within vehicle 24 to assume a laterally extending support position.

Downward rotation of platform 28 from its generally laterally extending support position is prevented by the engagement of a safety support means. The safety support means allows platform 28 to rotate between the stowed position and the support position. The safety support means may be a relatively unyielding safety block or bracket (not shown) which is engaged when platform 28 reaches its support position. Alternatively and preferably, the safety support means is a safety cable 64 having a predetermined length which is secured at one end 66 to mounting portion 40 and at the other end 68 to support platform 28. The length of safety cable 64 may be adjustable, thereby allowing the angle of platform 28 with respect to mounting portion 40 to be adjusted. This mounting arrangement positively prevents downward movement of platform 28 from its generally horizontal support position.

Safety cables 64 not only help to prevent platform 28 from pivoting too far, but also help to prevent the wheelchair and operator from inadvertently falling off of the sides of platform 28.

Other than the uses stated above, safety cables 64 are not used within actuating means 30. Safety cables 64 are not wound onto a drum during the operation of lift apparatus 20. Safety cables 64 do not pass around complicated cable pulley systems, nor are they exposed to grease or other contaminants. Consequently, safety cables 64 do not wear quickly or become subject to fraying or soiling as are commonly found in the cables and chains as taught by the prior art. If safety cables 64 are used and should the circumstance require, the operator of lift apparatus 20 may safely grab or brace himself or herself against safety cables 64 without fear of becoming dirty, being cut by frayed strands, or having an appendage or piece of clothing being snagged and drawn into actuating means 30. These are significant safety improvements.

Platform 28 may also incorporate other important safety features such as a pair of elongated guide rails 70, a movable gate means 32, and a movable bridge means 34.

As shown in FIG. 1, the elongated guide rails 70 may be provided on the top or sides of platform 28 to help prevent the wheelchair and operator from inadvertently rolling or stepping off of the sides of platform 28. In the preferred embodiment, guide rails 70 are spaced apart and are secured to the opposite sides of platform 28 to extend upward above the upper surface of gridwork 56.

Another significant improvement of the present invention over the teachings of the prior art is that a single actuating means 30, which will be discussed in detail below, may control the movement of not only mounting portion 40 and support platform 28, but also the engagement and release of one or more safety barriers. The safety barriers of the preferred embodiment are indicated in the figures as being movable gate means 32 and movable bridge means 34. Thus, gate means 32 and bridge means 34 may be engaged automatically and sequentially by the operation of actuating means 30 to prevent the exit of the wheelchair and operator from platform 28 except when platform 28 either rests upon the ground or is positioned level with raised bed 22 of vehicle 24.

In the preferred embodiment, movable gate means 32 is hingably connected to platform 28 near outer edge 63 by means of hinges 72 which allow for angular movement between a lowered ramp position and a raised safety barrier position. When located in its ramp position, gate means 32 serves as a ramp between the surface of the ground and the support surface of platform 28, thereby facilitating easy entry and exit of the wheelchair to and from platform 28 at ground level. When located in its raised safety barrier position, gate means 32 serves as a safety barrier blocking the passage of the wheelchair and preventing the wheelchair and operator from inadvertently falling or rolling off of outer edge 63 of platform 28.

Gate means 32 may be urged toward the ramp position by an urging means 74. As seen in FIGS. 1 through 6, urging means 74 may comprise a compression spring 76 which is compressed between an eccentric lever 78 and a brace or bracket 80. Lever 78 is attached to gate means 32 in such a manner as to force gate means 32 toward its ramp position. This may be done by causing the forces exerted by compression spring 76 to act eccentrically upon gate means 32 with respect to a rotational axis defined by hinges 72. Compression spring 76 may be braced at its other end to bracket 80 which in turn is attached to platform 28. An adjustment means 82, such as a threaded eye bolt, may be provided to adjust the forces exerted by compression spring 76. The operational features of gate means 32 will be discussed after bridge means 34 and actuating means 30 have been described in detail.

In the preferred embodiment, movable bridge means 34 is hingably connected to platform 28 near inner edge 59 by means of hinges 84 which allow for angular movement between a generally horizontal bridge position and a raised safety stop or barrier position. Bridge means 34 automatically assumes its bridge position when platform 28 is in either its raised support position or its stowed position. When located in its bridge position, bridge means 34 serves to bridge across any possible gap that might exist between inner edge 59 of platform 28 and raised bed 22, thereby enabling the wheelchair and operator to pass into vehicle 24 without falling down between platform 28 and raise bed 22. Bridge means 34 also serves as a ramp between raised bed 22 of vehicle 24 and the support surface of platform 28, thereby facilitating easy entry and exit of the wheelchair to and from platform 28 from raised bed 22. FIGS. 5 and 6 illustrate bridge means 34 in its bridge position.

The engagement of actuating means 30, automatically and sequentially activates the engagement of bridge means 34. As platform 28 is lowered by actuating means 30 from its upper support position to its lower support position, bridge means 34 is automatically and immediately urged against the lower threshold of access opening 42 which causes bridge means 34 to pivot about hinges 84 from its bridge position toward its raised safety stop or barrier position. When located in its raised position, bridge means 34 serves as a safety barrier blocking the passage of the vehicle and preventing the wheelchair and operator from inadvertently falling or rolling off of inner edge 59 between platform 28 and vehicle 24. Use of bridge means 34 significantly increases the safety of lift apparatus 20. FIGS. 1 through 4 show bridge means 34 in a safety barrier position.

ACTUATING MEANS

Lift apparatus 20 is operated by a single actuating means 30 which serves to control the movement of: gate means 32, bridge means 34, support platform 28, and mounting portion 40. More particularly, actuating means 30 automatically and sequentially controls and serves three distinct functions: (1) appropriately engages gate means 32 and bridge means 34 before platform 28 is moved between the lower and upper support positions, thereby preventing the wheelchair and operator from inadvertently falling off of platform 28; (2) moves platform 28 between the lower support position located at ground level and the upper support position located at floor level; and (3) when the wheelchair and operator have exited platform 28, moves platform 28 between its laterally extending support position and a generally upright stowed position.

To achieve these results, actuating means 30 may comprise a variety of drive systems, such as a gear and crank system, a chain and sprocket system, a winch and cable system, or the like.

In the preferred embodiment, actuating means 30 is of a cable-and-winch type, generally comprising: a cable means 86, a winch means 88, and a control means 90. For clarity, reference numeral 86 is not shown in the drawings. Instead, the component parts of cable means 86 are identified.

Generally, cable means 86 interconnects gate means 32, linkage means 26, and platform 28 to winch means 88, which in turn is controlled by control means 90. For example, cable means 86 may be connected to winch means 88 in such a manner that controlled rotation of winch means 88 causes cable means 86 to either be extended or retracted.

In the preferred embodiment, cable means 86 is operatively connected to lever 78 so that when platform 28 is located in its lower support position, retraction of cable means 86 first causes gate means 32 to move from its ramp position to its safety barrier position before platform 28 is raised from ground level. Likewise, at ground level cable means 86 may be extended or slackened to allow compression spring 76 to urge gate means 32 toward the ramp position.

Cable means 86 is also operatively connected to linkage means 26 for movement of mounting portion 40 between its extended position and its closed position. For example, once gate means 32 is raised to its safety barrier position, further retraction of cable means 86 will operatively act upon linkage means 26 moving mounting portion 40 toward its closed position and consequentially raising platform 28. Movement of linkage means 26 between its extended and closed positions results in the raising or lowering of platform 28 between the lower and upper support positions.

In the preferred embodiment, cable means 86 is also operatively connected to platform 28 for movement of platform 28 between the laterally extending support position and the stowed position. For example, once platform 28 has been raised to its upper support position, further retraction of cable means 86 will operatively act upon platform 28 to cause platform 28 to pivot toward its stowed position. The operation and particularly preferred configuration of cable means 86 will be discussed in further detail below.

Winch means 88 may comprise: a manual crank (not shown); a powered, reversible drive motor 92 having a rotatable shaft (not shown); or the like. In the preferred embodiment, winch means 88 has one or more take-up drums 94 attached to the rotatable shaft. For convenience and compactness, winch means 88 is securely attached to base portion 36, as shown in FIG. 1. Winch means 88 could alternatively be attached to raised bed 22, to another portion of vehicle 24, to mounting portion 40, or to platform 28.

In the preferred embodiment, winch means 88 comprises an integral one-half (½) horse power, direct current, twelve (12) volt electric drive motor 92 used with one dual winch take-up drum 94 which is driven through a 300-to-1 planetary gear reduction unit (not shown). When actuating means 30 is operated, cable means 86 is either wound or unwound from around drum 94 by drive motor 92. A shroud or cover (not shown) may be placed over drive motor 92 and drum 94 to protect the occupants of vehicle 24 from becoming soiled or injured through contact with cable means 86, drive motor 92, or drum 94.

Electrical power for drive motor 92 may be provided by a vehicle battery (not shown) supplied for operation of vehicle 24, or by a separate battery (not shown) specifically dedicated for use with lift apparatus 20.

A control means 90 (shown in FIGS. 1, 6 and 7) is provided to control the actuation of drive motor 92. Control means 90 may be a stationary, a remote, or a radio controlled switch which is easily accessible during use of lift apparatus 20. FIG. 6 illustrates the use of a remote control switch 96 which is standard equipment on the preferred embodiment. Remote control switch 96 preferably can be held for hand operation, such as by having a pistol grip configuration and control. FIG. 1 illustrates the use of a radio controlled switch 98, wherein a handheld transmitter 100 transmits electrical signals to a receiver 102 mounted on base portion 36. Once triggered, receiver 102 controls the actuation of drive motor 92. Cable means 86 will now be discussed in greater detail.

Figure 7:
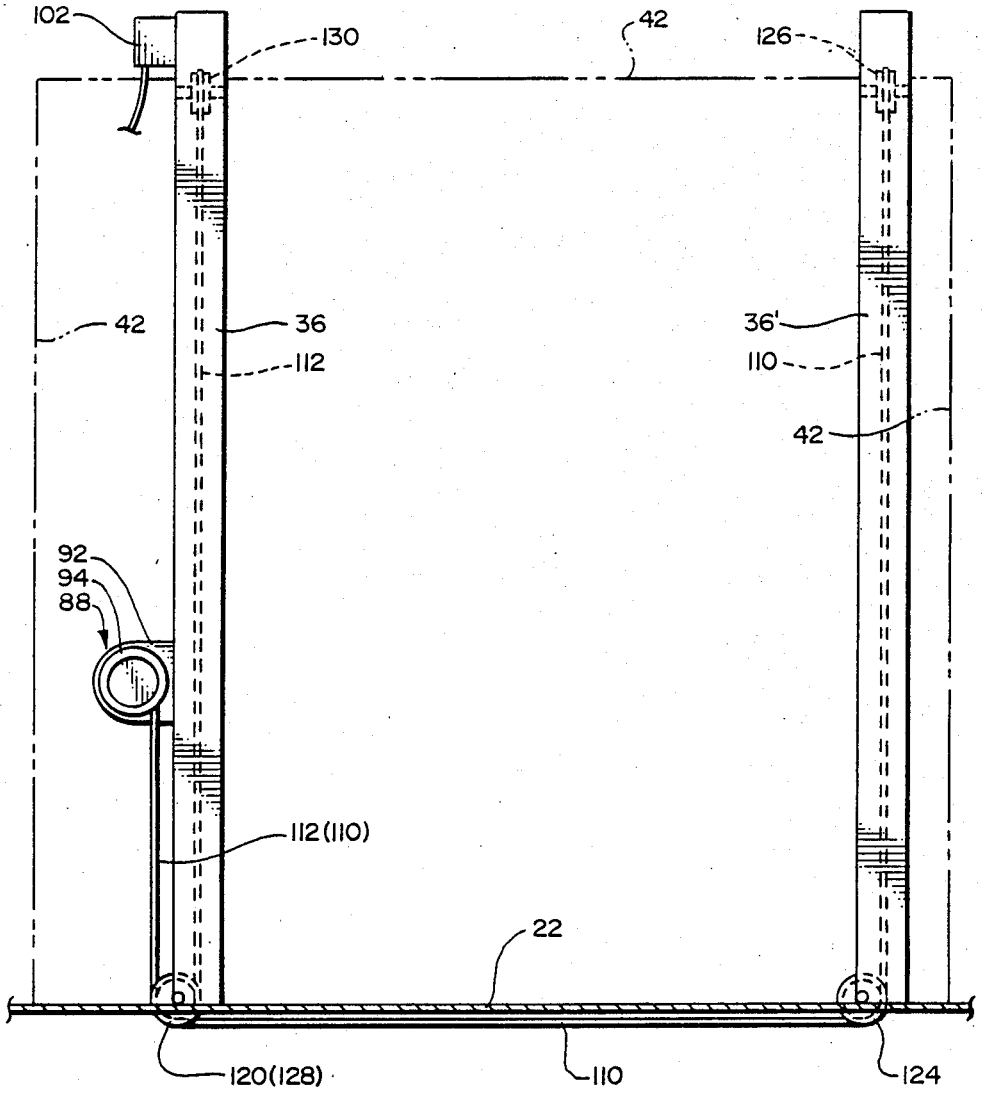
FIG. 7 is a cross-sectional elevational view of the lift apparatus taken along line 7—7 of FIG. 6.

As shown in FIGS. 1 and 7, the preferred embodiment uses two basically identical, spaced apart linkage means 26, each linkage means 26 being located near the opposite sides of access opening 42, with sufficient space therebetween to allow for passage of the wheelchair and operator.

For reasons of stability, cable means 86 preferably comprises two or more cables which traverse the distance between base portion 36 and mounting portion 40 and are operatively attached to one or more drums 94. Such a configuration allows a corresponding cable of cable means 86 to control the movement of each side of lift apparatus 20, as will be further explained.

In general terms, the cables are operatively connected to linkage means 26 to extend between base portion 36' and mounting portion 40', and extend between base portion 36 and mounting portion 40. Pulleys or rotatable cable sheaves are used to receive, support, and redirect the cables as they travel throughout lift apparatus 20. The sheaves are mounted to base portions 36' and 36, and to mounting portions 40, and 40 inside their respective channels.

In the preferred embodiment, cable means 86 comprises two distinct cables 110 and 112 used to control linkage portions 38' and 38 respectively. Cable 110 controls the movement of linkage portion 38'. Cable 112 controls the movement of linkage portion 38. By using a separate cable 110 and 112 for each linkage portion 38, and 38, actuating means 30 has better control over the movement of platform 28. Use of two cables also prevents tipping or torsional bending of platform 28 which might occur where only one cable is used. It is important that each of these two cables 110 and 112 be gathered at the same rate to prevent platform 28 from becoming askew. This may be done by winding and unwinding cables 110 and 112 from around drums 94 having the same relative dimensions.

A level winding device 114 (shown in FIG. 8) may be used to prevent cables 110 and 112, which are wound upon drums 94, from becoming jammed or bound together. Level winding device 114 of the preferred embodiment comprises a T-shaped spacer which is pivotally connected by a fastener 116 to base portion 36 near where drive motor 92 and drum 94 are mounted. Cables 110 and 112 each pass through a separate loop or opening provided on an upper cross bar 118 of the spacer. The distance between each loop or opening is determined by the dimensions of drums 94. As cables 110 and 112 are wound around drums 94, level winding device 114 maintains the spaced distance between each cable to prevent cable means 86 from becoming jammed or bound. Fastener 116 allows level winding device 114 to pivot with cables 110 and 112 as the cables are being wound around drum 94.

As shown in FIG. 7, cable 110 travels downward from drum 94, passes through a loop in upper crossbar 118 of level winding device 114 (shown in FIG. 8) and is received, supported, and redirected in a horizontal fashion by a rotatable sheave 120 toward the opposite side of access opening 42.

An opening 122 (shown in FIG. 1) may be cut into the framework of vehicle 24 near the lower end of each base portion 36, and 36 to allow cable 110 to pass across access opening 42 below raised bed 22. Alternatively, a cover plate (not shown) having sufficient clearance so as to not affect the movement of cable 110 may be placed over cable 110 to prevent anyone from tripping or catching cable 110 as they are moving the wheelchair to or from platform 28 when platform 28 is at substantially the same level as raised bed 22.

After having passed between base portions 36 and 36', cable 110 is supported, received, and redirected in a vertical fashion toward the upper end of base portion 36' by a rotatable sheave 124. Cable 110 passes upwardly within the channel of base portion 36', thereby increasing the safety of lift apparatus 20 by protecting the operator and passengers within vehicle 24 from inadvertently contacting cable 110.

Cable 110 is received and supported by a rotatable sheave 126 positioned near the top of base portion 36'. Sheave 126 redirects cable 110 to span across the space between base portion 36' and mounting portion 40', as shown in FIG. 1.

Figure 8:
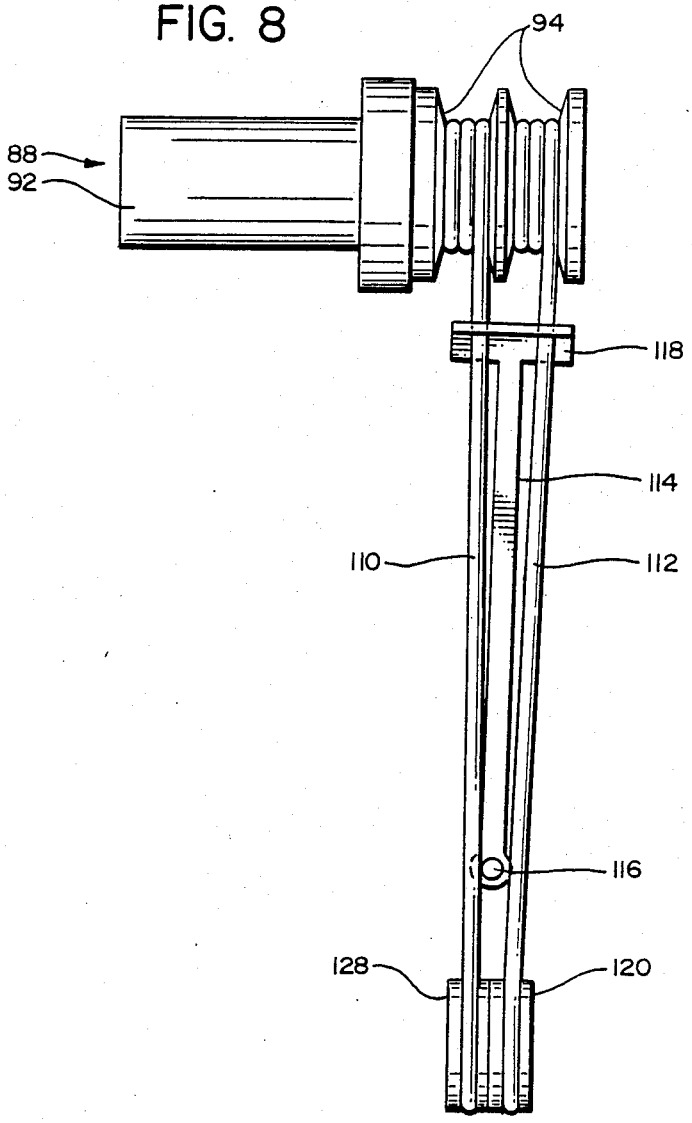
FIG. 8 is an enlarged schematic view of a portion of an actuating means, wherein a pivotal level winding device spaces two cables as the cables are wound or unwound from around a drum.

On the other side of lift apparatus 20, as best shown in FIGS. 1 and 8, cable 112 travels downward from drum 94, passes through a different loop of upper crossbar 118, and is received, supported, and redirected upwardly within the channel of base portion 36 by a rotatable sheave 128. Cable 112 is received and supported by a rotatable sheave 130 positioned near the top of base portion 36 and is redirected toward mounting portion 40.

In an alternative configuration not shown within the drawings, cables 110 and 112 could be securely attached to mounting portions 40' and 40, respectively. Such an embodiment however only allows actuating means 30 to move mounting portions 40' and 40 between their extended and closed positions, and to move platform 28 between its lower and upper support positions. Other embodiments, described below, permit lift apparatus 20 to partially or completely achieve all of the above stated objectives.

Cables 110 and 112 may serve the additional function of causing platform 28 to be raised or lowered between the stowed and laterally extending support positions. This may be accomplished by having cables 110 and 112 pass downward within the channels of mounting portions 40' and 40, respectively, and operatively attaching the cable 110 and 112 to platform 28 in such a manner that after the load has been removed from platform 28, further retraction of cables 110 and 112 causes platform 28 to pivot about pivot pins 60 and rotate from its laterally extending support position to its generally upright stowed position.

Sheaves 132 and 134 may be rotatably secured within the channel of mounting portion 40', sheave 132 being located near the top of mounting portion 40', and sheave 134 being located near the bottom of mounting portion 40' but above the location of pivot pin 60. Likewise, sheaves 136 and 138 may be rotatably secured within the channel of mounting portion 40, sheave 136 being located near the top of mounting portion 40, and sheave 138 being located near the bottom of mounting portion 40 but above the location of a corresponding pivot pin 60. Sheaves 132 and 136 receive cables 110 and 112 respectively, supporting and directing the cables. Cable 110 is supported and redirected by sheave 132 to travel downwardly within the channel of mounting portion 40'. Similarly, cable 112 is supported and redirected by sheave 136 to travel downwardly within the channel of mounting portion 40'.

Near the bottom of mounting portion 40', cable 110 may be supported and received by rotatable sheave 134 and be redirected through an opening cut into mounting portion 40'. Similarly, near the bottom of mounting portion 40, cable 112 may be received, supported, and redirected by sheave 138 through an opening cut into mounting portion 40. Cables 110 and 112 may then be operatively attached to platform 28 in such a manner that after the load has been removed from platform 28, further retraction of cables 110 and 112 causes platform 28 to pivot about pivot pins 60 and rotate from its laterally extending support position to its generally upright stowed position.

It is important that the force causing the rotation of platform 28 be sufficient to raise platform 28 to its stowed position. Such a force should, however, not be excessive. Caution should be taken to avoid the pivoting of platform 28 while a person or load remains thereon. This may be done by using a drive motor 92 having a limited horsepower, or by providing drive motor 92 and/or drum 94 with a clutch means (not shown). Another and preferred method is to control the forces being exerted upon lift apparatus 20 during each successive stage of movement.

In the preferred embodiment, cables 110 and 112 are operatively attached to platform 28 by means of a pulley mechanism 140. As shown in the cut away portions of FIGS. 2 through 6, cable 112 engages pulley mechanism 140 and is then secured to mounting portion 40 with a fastener 142. A cable 144 is operatively attached to pulley mechanism 140. Cable 144 travels downward within the channel of mounting portion 40, passes around sheave 138, is directed outward of a cut-away opening located at the base of mounting portion 40, and is subsequently secured to platform 28. A similar configuration would apply for cable 110 located within mounting portion 40'.

By using the pulley mechanism 140, shown in FIGS. 2 through 6, the resulting force exerted upon cables 144 on each side of lift apparatus 20 is generally twice the force exerted upon either cable 110 or cable 12. In the preferred embodiment, cables 144 are operatively connected to gate means 32 to raise gate means 32 from its ramp position to its safety barrier position. Use of pulley mechanism 140, thus, causes gate means 32 to raise at a slower rate than would otherwise occur if pulley mechanism 140 were not used.

In the preferred embodiment, cables 144 pass through openings in mounting portions 40 and 40' to be received, supported, and redirected by an offset sheaves 146 which in turn are secured to platform 28. The location of sheaves 146 and 138 and the location of pivot pin 60 determine in part, as will be explained below, the force exerted on platform 28 by actuating means 30. Offset sheave 146 may also be used to direct cable 144 away from the usable, operational areas of platform 28, thereby increasing the safety of lift apparatus 20.

Cable 144 is attached to lever 78 in such a manner that lever 78 and gate means 32 can pivot about hinges 72. When cable 144 is sufficiently extended to allow platform 28 to rest upon the ground and for gate means 32 to assume its ramp position, compression spring 76 serves to pull cables 144, 110, and 112 around the aforesaid sheaves and pulley mechanism 140, urging gate means 32 to rotate toward the ramp position.

Retraction of cables 110 and 112 causes cables 144 to retract, and lever 78 to pivot about hinges 72. This causes gate means 32 to pivot against the forces of compression spring 76 from its ramp position to its safety barrier position. Further retraction of cables 110 and 112 cause mounting portions 40 and 40' to move from their extended positions to their closed positions, raising support platform 28 from a position resting upon the ground to a position substantially level with raised bed 22. Once the load has been removed from platform 28, further retraction of cables 110 and 112 causes platform 28 to pivot about pivot pins 60 from a generally horizontal support position to an upright stowed position. The reverse functions occur when cables 110 and 112 are extended.

As a consequence of the design of the present invention, gate means 32 must rotate to its raised safety barrier position before platform 28 can be lifted. Gate means 32 remains in its safety barrier position during the raising and lowering of platform 28. When the wheel chair and operator enter upon platform 28 while platform 28 is in its upper support position, gate means 32 by design is already in its raised safety barrier position. Gate means 32 cannot be released from its raised safety barrier position until platform 28 rests completely upon the ground or another surface. Then, the tension within cables 144, 110, and 112, which would otherwise be required to resist the forces of gravity pulling down on the load and platform 28, will have been removed, allowing gate means 32 to assume its ramp position.

The method used in the present invention to assure gate means 32 is in its safety barrier position before platform 28 is raised, relies upon the same actuating means 30 that raises platform 28. The present design does not rely upon independent action of another actuating means, such as a spring or weight to place gate means 32 in a proper position. Likewise, the forces which maintain gate means 32 in place are equal if not greater than the forces needed to raise platform 28. In the preferred embodiment, both sides of gate means 32 are secured in the safety barrier position, thereby increasing the safety of lift apparatus 20.

Similarly, as has been previously explained, bridge means 34 is also automatically and sequentially controlled by actuating means 30. Bridge means 34 only assumes its bridge position when platform 28 is substantially level with raised bed 22. Bridge means 34 maintains such a bridge position while platform 28 is being moved between the upper support position and the stowed position. Immediately and automatically after platform 28 is lowered from the upper support position, bridge means 34 assumes a safety barrier position. The operator need only operate a single switch on control means 90 to actuate the movement of platform 28, mounting portions 40 and 40', gate means 32 and bridge means 34.

The operation and resulting forces of lift apparatus 20 will now be discussed in detail.

As indicated previously, when platform 28 is moved upwardly from its lower support position, the sequence of operation is that first, gate 32 swings upwardly to its safety barrier position. Secondly, the entire moveable assembly, including platform 28, gate 32, mounting portion 40, and linkage portion 38, moves upwardly, with platform 28 remaining generally horizontal. Thirdly, when platform 28 reaches its upper support position adjacent to the floor or raised bed 22 of vehicle 24, upward rotation of platform 28 begins. This sequence of operation takes place whether or not there is any load imposed on platform 28.

In lowering the platform 28 toward its lower ground engaging position, the sequence is just the opposite. First, platform 28 rotates downwardly from its stowed position to an upper support position. The entire movable assembly then moves outward and downward, moving platform 28 toward its lower support position. Once platform 28 reaches its lower support position, safety gate 32 rotates downwardly from its raised safety barrier position into its ramp position.

Figure 9:
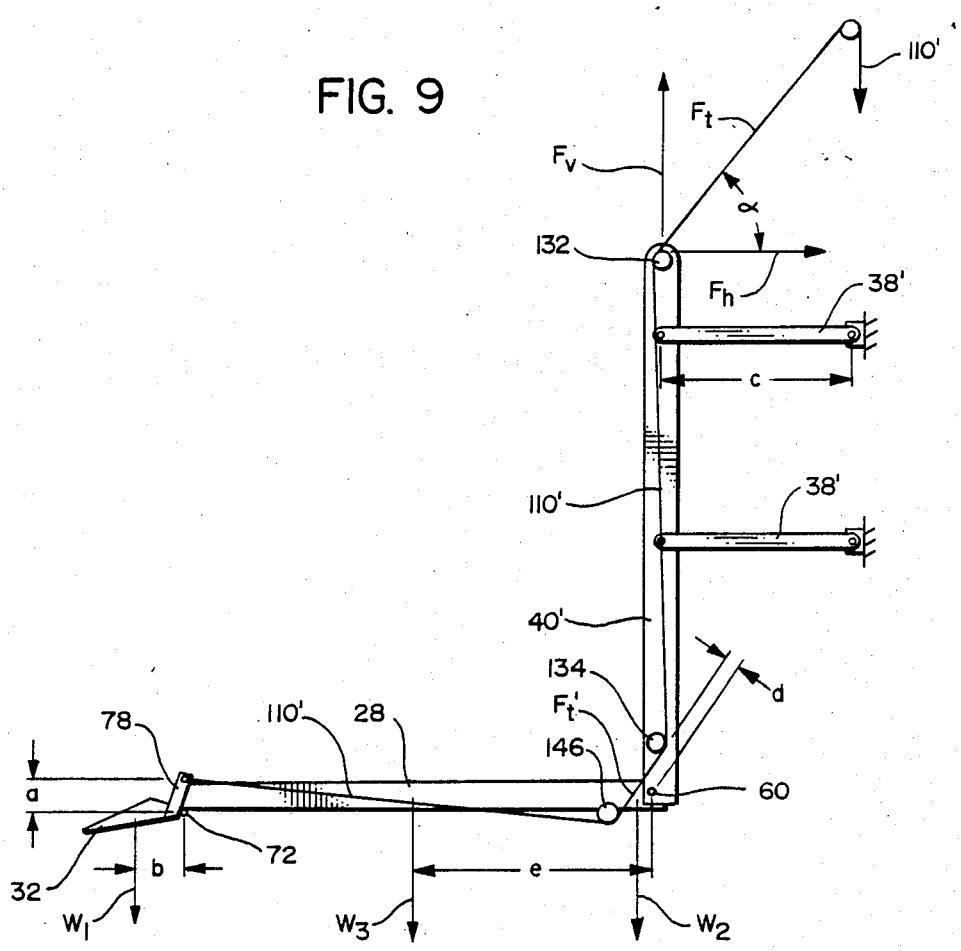
FIG. 9 is a schematic view of the pertinent forces exerted upon the apparatus as will be discussed in detail below.

For purposes of illustration in the schematic FIG. 9, cables 110, 112 and 144 are shown as simply a single cable 110'. For purposes of the present analysis, use of pulley mechanism will not be considered. It should be recognized, however, that use of pulley mechanism 140 creates a two to one mechanical advantage for cables 110 and 112 over the tension exerted by cables 144. The above stated sequence of movements can be explained by an appropriate treatment of cable 110'. As shown in FIG. 9., gate 32 has a certain mass which acts about its center of gravity. Gravity acts upon the mass of gate 32 to create a force $W_1$ having a negative moment of rotation. The moment arm for gate 32 is indicated by distance "b". To lift gate 32, it is necessary to counteract this moment (which is equal to $W_1 \times b$). This is done by the tension forces in cable 110' acting about the moment arm "a" of lever 78. Thus, to raise gate 32, the force on cable 110' multiplied by the distance "a" must create a moment greater than that caused by gravity moving gate 32 downwardly. Since gate 32 is relatively light in comparison with the rest of the structure of apparatus 20, and since moment arm "b" is relatively small, it takes a relatively small tension force on cable 110' to pull gate 32 upwardly into its raised safety barrier position and maintain such position during further movement of apparatus 20.

During the second stage of movement, greater tension force is exerted on cable 110' until such tension reaches a certain level. Once this second tension level is reached, the entire movable assembly begins to move vertically along an upward curving path defined by the length "c" of linkage portion 38'. As the apparatus reaches its upper limit of travel, the movable assembly travels in a more horizontally fashion.

The application of forces at the start of raising platform 28 should be sufficient for purposes of the present analysis. FIG. 9 can be used to analyze the tension force of cable 110' at this initial lifting stage of the entire movable assembly. The effective weight of the total movable assembly is represented at $W_2$.The tension force on cable 110' is indicated at $F_t$. Since cable 110' extends upwardly and rearwardly from the mounting member 40' at an angle $\alpha$, the effective force exerted by cable 110' can be divided into a vertical force component $F_v$ and a horizontal force component $F_h$. The assembly starts moving upwardly when a certain predetermined force $F_w$ in cable 110' is slightly greater than the force exerted by the total weight component $W_2$. The force $F_v$ exerted by cable 110' which is necessary to continue the lifting of the entire moveable assembly, will vary as the parallel linkages of linkage portion 38 rotate upwardly. Said force will also will vary as the angular orientation $\alpha$ of the portion of cable 110' extending from the upper end of the mounting portion 40' varies.

During the third stage of movement, the tension force exerted by cable 110' causes the upwardly rotation of platform 28 from a laterally extending position to its stowed position. It is noted there is a portion of cable 110' which slants downwardly and forwardly at a location closely adjacent to the pivot pin 60 of platform 28. The tension force at this segment of cable 110' is indicated as $F_t'$. Force $F_t'$ acts about a moment arm having a distance "d" which is equal to the perpendicular distance from pivot pin 60 to the adjacent segment of cable 110'. Please note that moment arm "d" is a relatively short.

The combined weight of platform 28 and gate 32 is indicated at $W_3$, which acts about a moment arm having a distance "e". The total negative moment tending to rotate platform 28 downwardly or counterclockwise is equal to $W_3 \times e$. When the tension force on cable 110' reaches a level where the moment $F_t' \times d$ is slightly greater than the moment $W_3 \times e$, then platform 28 begins to rotate upwardly. Since the moment arm "d" is kept relatively small, tension force $F_t'$ on cable 110' must be relatively high before rotation will occur.

With the above analysis in mind, let us now review the sequence of operation in lifting the entire movable assembly upwardly from a lower support position, to an upper support position, and then on to a stowed position. As drive motor 92 begins to reel in cable 110', a first predetermined tension level on cable 110' is reached and gate 32 is rotated upwardly to a safety barrier position. Gate 32 becomes effectively locked in its raised safety barrier position. Thereafter, platform 28 and gate 32 function as a single unitary member.

Very shortly thereafter, the tension on cable 110' reaches a second higher level, so that force $F_v$ is able to counteract the total weight component $W_2$, and the entire movable assembly begins to move upwardly. During this second stage raising, mounting portion 40', platform 28, and gate 32 all remain stationary relative to one another. The tension force exerted by cable 110' is not yet sufficient to create any rotation of platform 28.

When mounting portion 40 arrives at its uppermost closed position, the tension force on cable 110' increases yet further to force platform 28 from its upper support position to its stowed position. At this point, tension force $F_t'$ in cable 110' is sufficiently great, in that the moment $F_t' \times d$ is greater than the moment $W_3 \times e$, which causes platform 28 to begin to rotate upwardly.

Thus, it can be appreciated that by proper deployment of cable 110', proper sequence of operation can be achieved. Further, this sequencing of the movement of the various component parts of apparatus 20 is accomplished by operating cable 110' at three different tension levels to exert the appropriate moments in the proper sequence.

By using one or more of the above mentioned methods or other similar methods, platform 28 may be controlled to remain generally horizontal until the wheelchair and operator have exited platform 28 and actuating means 30 is again engaged.

As has been explained, actuating means 30 may be used to engage or release one or more safety barriers to prevent the wheelchair and operator from falling off of platform 28. For example, in the preferred embodiment, the extension or retraction of extension cables 144 serves to control the movement of gate means 32. Likewise, the extension or contraction of cables 110 and 112 raises or lowers platform 28 and consequentially also moves bridge means 34.

In the preferred embodiment all of the above identified elements are made of a material having sufficient strength and durability to withstand the axial, sheer, and torsional forces which are exerted upon them during operation of lift apparatus 20. Extra structural material should be provided for an adequate safety factor. For example, lift apparatus 20 may be fabricated from steel for enhanced safety, strength, and longevity. Other metals and composite materials meeting the above mentioned requirements may also be used. All of the cables are preferably made from aircraft-type cables or similar quality materials for durability and for preventing the cables from becoming fouled or piled up.

The pivot pins, hinges and sheaves are preferably secured into place, such as by welding, to assure maintained safety and to prevent tampering. Thus, the pivot pins, hinges and sheaves are prevented from escaping their placement, allowing for relative maintenance-free operation. In the preferred embodiment, the steel sheaves are designed so that cables 110, 112, and 144 can not come off of the sheave groove. This is done by limiting the clearance between the cables set within the sheave groove and the framework of lift apparatus 20. The sheaves may be installed with Oillite, permanently lubricated bushings for maintenance-free operation.

While the drawings depict the preferred embodiment of the invention, the preceding text provides a description of not only the preferred embodiment, but also many other embodiments of the invention. It is to be understood that the invention is not limited to these described embodiments or to the specific features shown herein, since the means and construction disclosed comprise primarily a preferred form of putting the invention into effect. Persons skilled in the art to which the invention pertains may consider the foregoing teachings to make modifications and other embodiments of the invention. Additionally, one skilled in the art may appreciate that the lift apparatus may have a wide variety of shapes and configurations. The illustrated application is merely illustrative of one embodiment, many more of which would fall within the scope of the claims. The invention is not limited to a single embodiment but rather includes all alternatives, modifications, and equivalent embodiments. For example, although it is the intention of the Applicant that lift apparatus 20 be used to assist a person confined to a wheelchair to enter and exit vehicle 24 without the assistance of another individual, it is to be understood that other cargo and loads may be used in conjunction with this invention. Similarly, raised bed 22 may comprise any raised structure. For example, even though some of the spring mechanisms have been shown as coil springs, leaf springs could be used. Further, while the drawings show the lower part of this apparatus extending into and below the bed 22 of the vehicle, the apparatus can advantageously be mounted so that it is entirely above the bed 22 so that no modification to the bed 22 is required. This latter arrangement (i.e., where the entire apparatus is above the bed 22) would, in many instances, be a preferred embodiment. The Applicant claims the invention in all its forms and modifications within the legitimate and valid scope of the appended claims, appropriately interpreted under the Doctrine of Equivalents.

INDUSTRIAL APPLICABILITY

This invention is particularly effective and well adapted for safe movement of a wheelchair and its occupant to and from an elevated bed of a vehicle. This invention is designed to be safe, structurally sound, and very compact when stowed. This invention is designed to use a single actuating means to safely control the movement of a support platform between an upright stowed position and a laterally extending support position; to move the platform between an upper support position which is level with the raised bed and a lower support position which is level with the ground; to move a gate means between a lowered ramp position and a raised safety barrier position; and to move a bridge means between a bridge position and a safety barrier position. The gate means and bridge means are used to prevent the load from falling off of the platform.

I claim:

1. An apparatus adapted to be mounted to a structure, such as a vehicle, for moving a wheelchair and its occupant to and from a generally horizontal raised bed of said structure, said apparatus comprising:

a. a support linkage comprising:

i. a base means comprising a pair of first and second laterally spaced, vertically positioned base support members;

ii. a pair of laterally spaced vertically aligned first and second mounting members;

iii. a parallel linkage means interconnecting said base support members with said mounting members in a manner that said mounting members are moveable back and forth between a closed position where each of said mounting members is positioned adjacent to a related one of said support members, and an extended position where said mounting members are moved forwardly and downwardly from said support members while maintaining a vertically aligned orientation in moving between said closed position and said extended position;

b. a support platform having a rear end portion pivotally connected to lower ends of said mounting members about a hinge axis, in a manner to be moveable between a horizontal support position where the platform extends forwardly from said mounting members, and a stowed position where said platform extends vertically upwardly from said hinge axis and is positioned adjacent to said mounting members;

c. actuating means adapted to move said mounting members between said closed and extended positions, and also to move said support platform between said stowed and support positions, said actuating means comprising first and second cable means and a cable winding means attached to said cables in a manner to be able to extend and retract said cable means, said first and second cables extending from upper ends of said first and second support members to upper ends of said first and second mounting members, respectively, thence downwardly along said mounting members to locations above said hinge axis, and then downwardly and forwardly to engage opposite sides of said platforms at a location spaced from said hinge axis;

d. said actuating means being arranged in a manner that when a retracting force is exerted on said cable means, at a first lower predetermined level of retracting force, cable means portions extending between upper ends of said support members and said mounting members exert a moment on said mounting members sufficient to raise said mounting members and said platform upwardly so that said mounting members move toward said closed position while said platform remains in its horizontal support position until said mounting members are in said closed position, said actuating means being further characterized in that with a second greater retracting force exerted on said cable means, with said mounting members being in said closed position, a moment is exerted on said platform about said hinge axis to rotate said platform upwardly and rearwardly from said horizontal support position to said vertical stowed position.

2. The apparatus as recited in claim 22, wherein there is a stop means arranged to come into operative engagement between at least one of said mounting members and said platform to limit downward movement of said platform so that said platform does not drop below said support position.

3. The apparatus as recited in claim 2, wherein said stop means comprises support cable means connecting between said at least one of said mounting members and said platform at locations spaced from said hinge axis.

4. The apparatus as recited in claim 1, wherein there is a gate means mounted to a forward end of said platform so as to be moveable from a raised safety position downwardly to an unobstructed position, at least one of said cable means extending from a location at which said one of said cable means engages said platform forwardly to engage said gate means in a manner that a retracting force on said one of said cable means raises said gate means to the raised safety position when a retracting force lower than said first retracting force is exerted on said one of said cable means.

5. The apparatus as recited in claim 4, further comprising compression spring means positioned around said one of said cable means and engaging said gate means to urge said gate means toward said lower position.

6. The apparatus as recited in claim 1, wherein each of said cable means engages related sheave means at an upper end of its related mounting member.

7. The apparatus as recited in claim 1, wherein each of said cable means comprises first and second cable sections, namely a first cable section extending between said cable winding means to engage an intermediate sheave member positioned in a related one of said support members and to connect to said related one of said support members, and a second cable section connected to and extending from said intermediate sheave member to engage said platform, whereby retraction of said first cable section causes upward movement of said intermediate sheave member to in turn cause retraction of said second cable section.

8. The apparatus as recited in claim 1, wherein said cable winding means comprises rotatably mounted cable winding drum means having two laterally spaced first and second drum sections, which are arranged to have wound thereon said first and second cable means, respectively, said cable winding means further comprising a spacing means having two spaced cable locating means, each of which engages a related cable means to space said cable means a predetermined distance from one another, said cable spacing means being positioned adjacent to said drum means so as to cause said cables to be wound onto said drum sections at spaced locations corresponding to spacing of said cable locating means on said spacing means, whereby as said drum means rotates to retract said cable means, said cable means are wound on corresponding locations of said drum sections in a manner that said cable means are necessarily wound similarly and evenly on said drum sections.

9. The apparatus as recited in claim 8, wherein said cable spacing means is mounted so as to be moveable along an axis of rotation of said drum means whereby said cable spacing means moves laterally parallel to said axis of said drum spacing means so that said cable means remain at corresponding locations on said two drum sections as the cable means are being wound on said drum sections.

10. The apparatus as recited in claim 9, wherein said cable spacing means is pivotally mounted at locations spaced from said cable spacing means so as to permit said lateral movement of said cable spacing means.

11. The apparatus as recited in claim 1, wherein said first and second cable means extend from said cable winding means into a lower ends of said first and second support members, respectively, upwardly therethrough over upper support sheave means, and outwardly from upper ends of said support members, thence to upper mounting sheave means at upper ends of said first and second mounting members, respectively, downwardly therethrough, to lower mounting sheave means at a lower location above said hinge axis and thence downwardly and forwardly to engage said platform at locations spaced from said hinge axis.

12. The apparatus as recited in claim 1, comprising:

a. a stop means arranged to come into operative engagement between at least one of said mounting members and said platform to limit downward movement of said platform so that said platform does not drop below said support position;

b. a gate means mounted to a forward end of said platform so as to be moveable from a raised safety position downwardly to an unobstructed position, at least one of said cable means extending from a location at which said one of said cable means engages said platform forwardly to engage said gate means in a manner that a retracting force on said one of said cable means raises said gate means to the raised safety position when a retracting force lower than said first retracting force is exerted on said one of said cable means;

c. said first and second cable means extend from said cable winding means into a lower ends of said first and second support members, respectively, upwardly therethrough over upper support sheave means, and outwardly from an upper ends of said support member, thence to upper mounting sheave means at upper ends of said first and second mounting members, respectively, downwardly therethrough to lower mounting sheave means at a lower location above said hinge axis and thence downwardly and forwardly to engage said platform at locations spaced from said hinge axis.

13. The apparatus as recited in claim 12, comprising:

a. stop means comprises support cable means connecting between said one of said mounting members and said platform at locations spaced from said hinge axis;

b. said cable means engaging related sheave means at an upper end of its related mounting member.

14. An apparatus adapted to be mounted to a structure, such as a vehicle, for moving an entity, such as a wheelchair and its occupant, to and from a raised location, said apparatus comprising:

a. a support platform moveable between a lower and an upper position;

b. a base support structure;

c. a linkage means interconnecting said platform with said base structure to enable said platform to move from the lower position to the upper position, relative to said base structure;

d. actuating means adapted to move said platform relative to said base structure, said actuating means comprising first and second cable means;

e. a cable winding drum means having two laterally spaced first and second drum sections, which are arranged to have wound thereon said first and second cable means, respectively, said cable winding means further comprising a spacing means having two spaced cable locating means, each of which engages a related cable means to space said cable means a predetermined distance from one another, said cable spacing means being positioned adjacent to said drum means so as to cause said cable means to be wound onto said drum sections at spaced locations corresponding to spacing of said cable locating means on said spacing means, whereby as said drum means rotates to retract said cable means, said cable means are wound on corresponding locations of said drum sections in a manner that said cable means are necessarily wound similarly on said drum sections.

15. The apparatus as recited in claim 14, wherein said cable spacing means is mounted so as to be moveable along an axis of rotation of said drum means whereby said cable spacing means moves laterally parallel to said axis of said drum spacing means so that said cable means remain at corresponding locations on said two drum sections as the cable means are being wound on said drum sections.

16. The apparatus as recited in claim 15, wherein wherein said cable spacing means is pivotally mounted at locations spaced from said cable spacing means so as to permit said lateral movement of said cable spacing means.

17. An apparatus mountable to a vehicle, for moving a wheelchair and its occupant to and from a generally horizontal raised bed of said vehicle, comprising:

a. linkage means having a base portion, a linkage portion, and a mounting portion, said base portion having a fixed vertical orientation relative to said raised bed, said linkage portion interconnecting said base portion and said mounting portion, said mounting portion being movable relative to said base portion between an extended position and a closed position, said mounting portion being juxtaposed against said base portion when in said closed position, said mounting portion maintaining a vertical orientation relative to said base portion;

b. a support platform mounted to said mounting portion, said platform being movable relative to said base portion between a laterally extending upper support position substantially level with said raised bed and a laterally extending lower support position located substantially at ground level;

c. actuating means operatively connected to said linkage means to move said mounting portion between said extended position and said closed position and thereby move said platform between said upper support position and said lower support position, said mounting portion assuming said closed position when said platform assumes said upper support position;

d. said platform being movable relative to said mounting portion between a laterally extending support position and a generally upright stowed position;

e. said actuating means being operatively connected to said platform to move said platform between said laterally extending support position and said stowed position when said wheelchair and said occupant are not upon said platform; and clutch means for preventing said actuating means from moving said platform from said laterally extending support position to said stowed position if said wheelchair and aid occupant are positioned upon said platform.

18. An apparatus mountable to a vehicle, for moving a wheelchair and its occupant to and from a generally horizontal raised bed of said vehicle, comprising:

a. linkage means having a base portion, a linkage portion, and a mounting portion, said base portion having a fixed vertical orientation relative to said raised bed, said linkage portion interconnecting said abase portion and said mounting portion, said mounting portion being movable relative to said base portion between an extended position and a closed position, said mounting portion being juxtaposed against said base portion when in said closed position, said mounting portion maintaining vertical orientation relative to said base portion;

b. a support platform mounted to said mounting portion, said platform being movable relative to said base portion between a laterally extending upper support position substantially level with said raised bed and a laterally extending lower support position located substantially at ground level;

c. actuating means operatively connected to said linkage means to move said mounting portion between said extended position and said closed position and thereby move said platform between said upper support position and said lower support position, said mounting portion assuming said closed position when said platform assumes said upper support position, said actuating means comprising:

i. cable means operatively connected to said linkage means, said cable means extending between said base portion and said mounting portion; and ii. winch means operatively connected to said cable means, extension or retraction of said cable means from said winch means moving said mounting portion between said closed position and said extended position.

d. a portion of said cable means being located longitudinally within said base portion, and within said mounting portion;

e. at least one rotatable sheave attached to said mounting portion whereby said cable means is restricted from relative lateral movement with respect to said mounting portion as said cable means enters or exits said mounting portion.

* * * * *

UNITED STATES PATENT AND TRADEMARK OFFICE
CERTIFICATE OF CORRECTION

PATENT NO. : 4,984,955

DATED : January 15, 1991

INVENTOR(S) : ROBERT D. McCULLOUGH

It is certified that error appears in the above-identified patent and that said Letters Patent is hereby corrected as shown below:

On title page, line (76), Inventor:

"C." should read --D.--

Signed and Sealed this

First Day of December, 1992

*Attest:*

*Attesting Officer*

DOUGLAS B. COMER

*Acting Commissioner of Patents and Trademarks*